US006073811A

United States Patent [19]

Costea

[11] Patent Number: 6,073,811

[45] Date of Patent: Jun. 13, 2000

[54] CARBONATED BEVERAGE DISPENSER

[76] Inventor: Thomas Costea, 359 S. Dalesford Dr., La Puente, Calif. 91744

[21] Appl. No.: 09/186,242

[22] Filed: Nov. 5, 1998

[51] Int. Cl.[7] ..... B67D 5/06

[52] U.S. Cl. ..... 222/183; 222/399; 222/400.7

[58] Field of Search ..... 222/131, 183, 222/185.1, 399, 400.7, 108, 464.1

[56] References Cited

U.S. PATENT DOCUMENTS

| | | | |
|---|---|---|---|
| 3,315,846 | 4/1967 | Landis et al. | 222/400.7 |
| 3,317,089 | 5/1967 | Kopczynski | 222/400.7 |
| 3,325,053 | 6/1967 | De Boer | 222/400.7 X |
| 4,265,374 | 5/1981 | Sebalos | 222/464.1 X |
| 5,240,144 | 8/1993 | Feldman | 222/131 X |

*Primary Examiner*—Philippe Derakshani

[57] ABSTRACT

A carbonated beverage dispenser for dispensing a pre-mixed carbonated beverage in a bottle such as a 2 or 3 liter bottle. The carbonated beverage dispenser includes a base housing with a cradle in the top of the base housing for receiving a beverage container therein. A dispensing tap is designed for attachment to a threaded opening of the beverage container to substantially cover the threaded opening of the beverage container. An elongate draw tube outwardly extends from the dispensing tap and is in fluid communication with the dispensing spout. The draw tube is designed for extending through the threaded opening of the beverage container into the beverage container. A pressurized gas supply is designed for fluid communication with the beverage container.

14 Claims, 3 Drawing Sheets

16
13
14
37
38

15
11
12
1
20
36
23
19
22
10
21
32
14
31
16
13
16
37

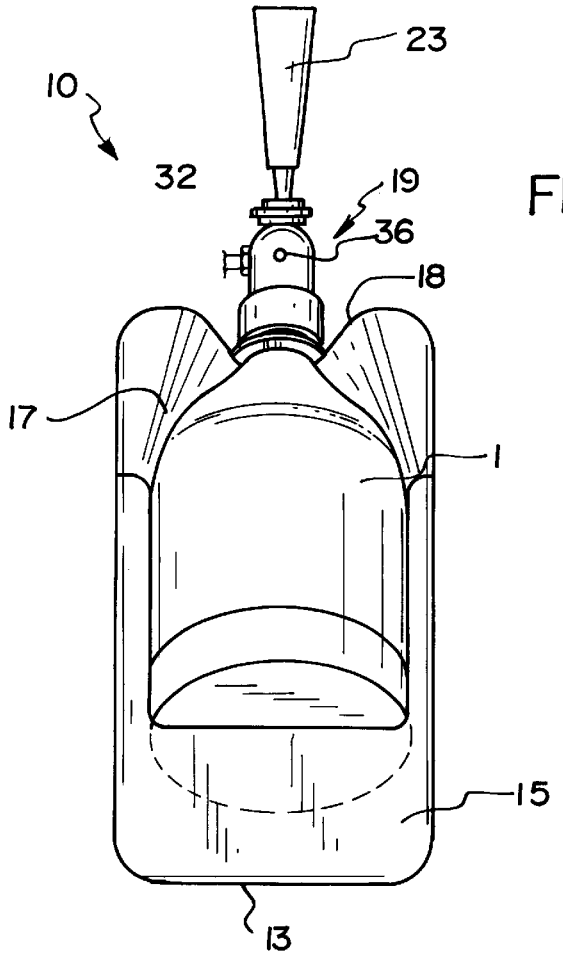
FIG. 6
FIG. 7
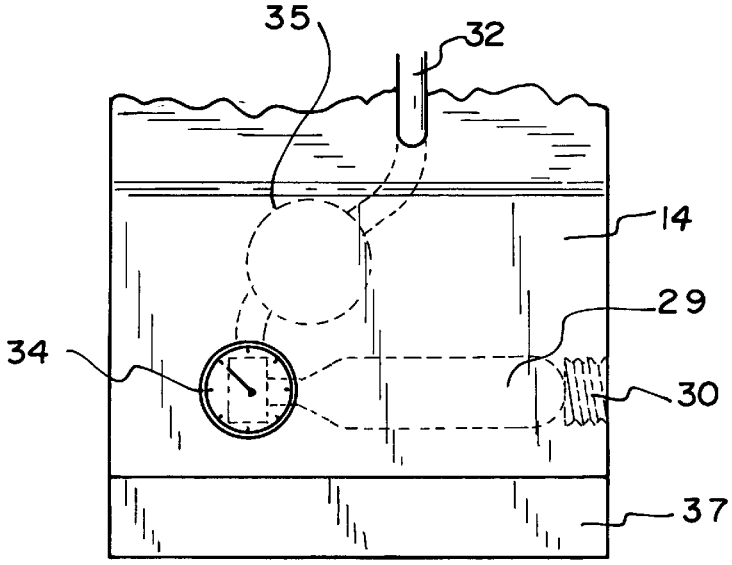

CARBONATED BEVERAGE DISPENSER

BACKGROUND OF THE INVENTION

1. Field of the Invention

The present invention relates to pressurized drink dispensing system and more particularly pertains to a new carbonated beverage dispenser for dispensing a pre-mixed carbonated beverage in a bottle such as a 2 or 3 liter bottle.

2. Description of the Prior Art

The use of carbonated beverage dispensers is known in the prior art. More specifically, carbonated beverage dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,932,561; 5,040,703; 5,118,009; 4,512,377; Des. 379,050; and 2,216,890.

While these devices fulfill their respective, particular objectives and requirements, the aforementioned patents do not disclose a new carbonated beverage dispenser. The inventive device includes a base housing with a cradle in the top of the base housing for receiving a beverage container therein. A dispensing tap is designed for attachment to a threaded opening of the beverage container to substantially cover the threaded opening of the beverage container. An elongate draw tube outwardly extends from the dispensing tap and is in fluid communication with the dispensing spout. The draw tube is designed for extending through the threaded opening of the beverage container into the beverage container. A pressurized gas supply is designed for fluid communication with the beverage container.

In these respects, the carbonated beverage dispenser according to the present invention substantially departs from the conventional concepts and designs of the prior art, and in so doing provides an apparatus primarily developed for the purpose of dispensing a pre-mixed carbonated beverage in a bottle such as a 2 or 3 liter bottle.

SUMMARY OF THE INVENTION

In view of the foregoing disadvantages inherent in the known types of carbonated beverage dispensers now present in the prior art, the present invention provides a new carbonated beverage dispenser construction wherein the same can be utilized for dispensing a pre-mixed carbonated beverage in a bottle such as a 2 or 3 liter bottle.

The general purpose of the present invention, which will be described subsequently in greater detail, is to provide a new carbonated beverage dispenser apparatus and method which has many of the advantages of the carbonated beverage dispensers mentioned heretofore and many novel features that result in a new carbonated beverage dispenser which is not anticipated, rendered obvious, suggested, or even implied by any of the prior art carbonated beverage dispensers, either alone or in any combination thereof.

To attain this, the present invention generally comprises a base housing with a cradle in the top of the base housing for receiving a beverage container therein. A dispensing tap is designed for attachment to a threaded opening of the beverage container to substantially cover the threaded opening of the beverage container. An elongate draw tube outwardly extends from the dispensing tap and is in fluid communication with the dispensing spout. The draw tube is designed for extending through the threaded opening of the beverage container into the beverage container. A pressurized gas supply is designed for fluid communication with the beverage container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new carbonated beverage dispenser apparatus and method which has many of the advantages of the carbonated beverage dispensers mentioned heretofore and many novel features that result in a new carbonated beverage dispenser which is not anticipated, rendered obvious, suggested, or even implied by any of the prior art carbonated beverage dispensers, either alone or in any combination thereof.

It is another object of the present invention to provide a new carbonated beverage dispenser which may be easily and efficiently manufactured and marketed.

It is a further object of the present invention to provide a new carbonated beverage dispenser which is of a durable and reliable construction.

An even further object of the,present invention is to provide a new carbonated beverage dispenser which is susceptible of a low cost of manufacture with regard to both materials and labor, and which accordingly is then susceptible of low prices of sale to the consuming public, thereby making such carbonated beverage dispenser economically available to the buying public.

Still yet another object of the present invention is to provide a new carbonated beverage dispenser which provides in the apparatuses and methods of the prior art some of the advantages thereof, while simultaneously overcoming some of the disadvantages normally associated therewith.

Still another object of the present invention is to provide a new carbonated beverage dispenser for dispensing a pre-mixed carbonated beverage in a bottle such as a 2 or 3 liter bottle.

Yet another object of the present invention is to provide a new carbonated beverage dispenser which includes a base housing with a cradle in the top of the base housing for receiving a beverage container therein. A dispensing tap is designed for attachment to a threaded opening of the beverage container to substantially cover the threaded opening of the beverage container. An elongate draw tube outwardly extends from the dispensing tap and is in fluid communication with the dispensing spout. The draw tube is designed for extending through the threaded opening of the beverage container into the beverage container. A pressurized gas supply is designed for fluid communication with the beverage container.

Still yet another object of the present invention is to provide a new carbonated beverage dispenser that maintains the carbonation of a bottled pre-mixed carbonated beverage so that the beverage does not become flat after opening.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a schematic perspective view of the present invention from the back of the base housing.

FIG. 7 is a schematic partial front side view of the present invention.

DESCRIPTION OF THE PREFERRED EMBODIMENT

Figures 1, 2:
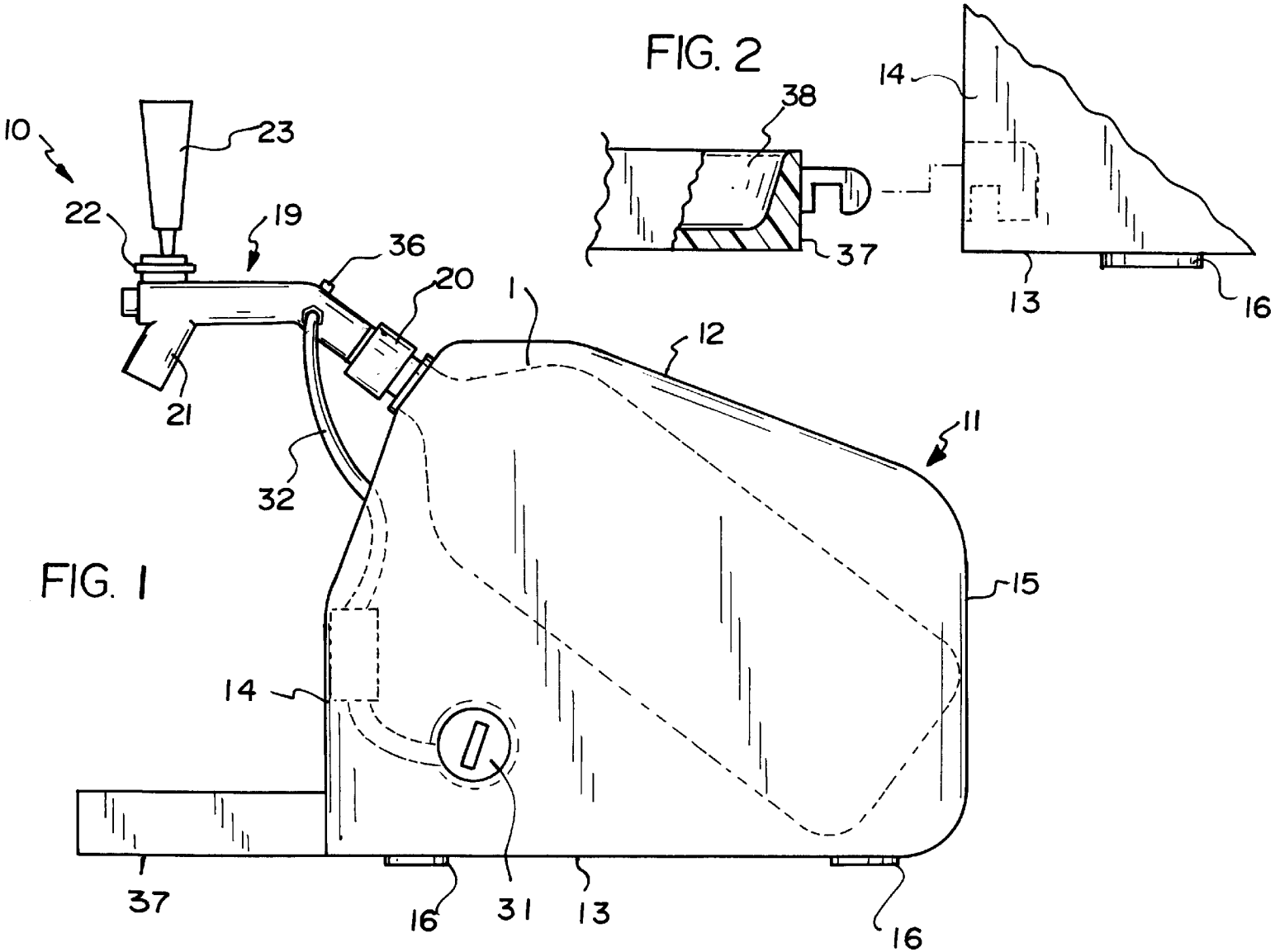
FIG. 1 is a schematic side view of a new carbonated beverage dispenser in use according to the present invention.
FIG. 2 is a schematic enlarged exploded partial side view of the attachment of the drip tray of the present invention.
Figure 3:
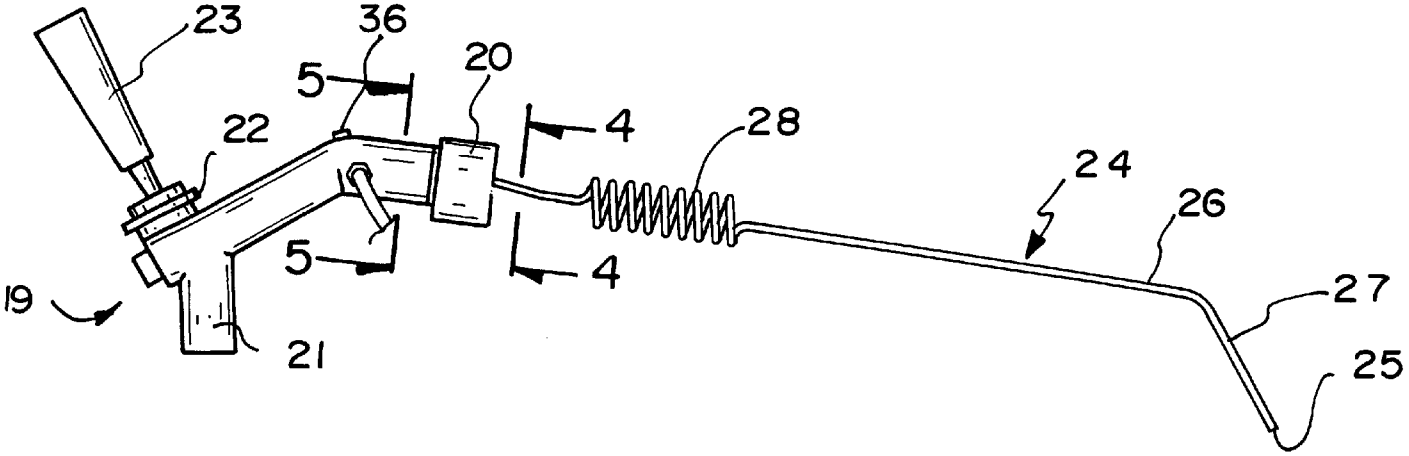
FIG. 3 is a schematic side view of the dispensing tap and draw tube of the present invention.
Figure 5:
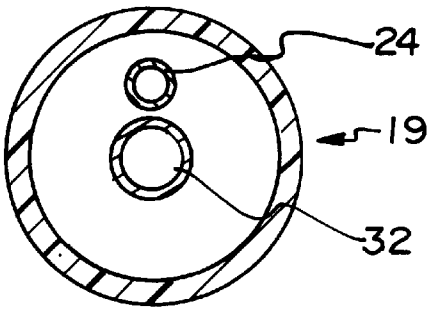
FIG. 5 is a schematic cross sectional view taken from line 5—5 of FIG. 3.
Figure 4:
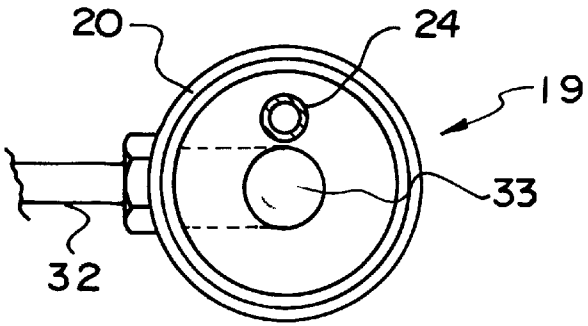
FIG. 4 is a schematic cross sectional view taken from line 4—4 of FIG. 3.

With reference now to the drawings, and in particular to FIGS. 1 through 7 thereof, a new carbonated beverage dispenser embodying the principles and concepts of the present invention and generally designated by the reference numeral 10 will be described.

As best illustrated in FIGS. 1 through 7, the carbonated beverage dispenser 10 generally comprises a base housing with a cradle in the top of the base housing for receiving a beverage container therein. A dispensing tap is designed for attachment to a threaded opening of the beverage container to substantially cover the threaded opening of the beverage container. An elongate draw tube outwardly extends from the dispensing tap and is in fluid communication with the dispensing spout. The draw tube is designed for extending through the threaded opening of the beverage container into the beverage container. A pressurized gas supply is designed for fluid communication with the beverage container.

In closer detail, the dispenser 10 is designed for use with a beverage container 1 for holding a pre-mixed carbonated beverage and having a threaded opening therein such as conventional two and three liter soft drink bottles. Specifically, the dispenser 10 comprises a base housing 11 having a top 12, a bottom 13, a front 14 and a back 15. The bottom of the base housing is designed for resting on a resting surface and preferably has a plurality of resting pads 16 for resting on the resting surface. Ideally, the resting pads comprise a resiliently deformable material such as a resiliently deformable rubber or plastic for frictionally enhancing the resting pads to help prevent sliding of the resting pads on a smooth resting surface.

The base housing has a cradle 17 in the top of the base housing. The cradle of the base housing is designed for receiving a beverage container therein. The cradle of the base housing is designed for holding the beverage container therein at an acute angle with respect to the resting surface. Preferably, the acute angle of the cradle is between about 30 degrees and about 75 degrees. Ideally, the acute angle of the cradle is about 60 degrees. The cradle has a generally V-shaped upper saddle 18 at the top of the base housing adjacent the front of the base housing. The upper saddle of the cradle is designed for receiving a neck of the beverage container therein such that a threaded opening of the beverage container faces outwardly from the base housing in a upwards direction.

A dispensing tap 19 is provided for attachment to the threaded opening of the beverage container to substantially cover the threaded opening of the beverage container in a substantially air tight manner. Preferably, the dispensing tap has a rotatably mounted coupling nut 20 designed for threaded attachment to the threaded opening of the beverage container to attach the dispensing tap to the threaded opening of the beverage container. The dispensing tap has a dispensing spout 21 and a tap valve 22 for selectively opening and closing passage of fluid through the dispensing spout. The tap valve has a pivotally mounting lever actuator 23 upwardly extending from the dispensing tap for permitting a user to selectively open and close the tap valve.

An elongate draw tube 24 outwardly extends from the dispensing tap and is in fluid communication with the dispensing spout. The draw tube is designed for extending through the threaded opening of the beverage container into the beverage container. The draw tube terminates at an open distal end 25. The distal end of the draw tube is designed for positioning towards a bottom of the beverage container to permit drawing of fluid from the beverage container into the draw tube. Ideally, the draw tube has an inner diameter of about 3/16 inch for providing an optimal size for drawing fluid into the draw tube.

The draw tube has a bend located between the dispensing tap and the distal end of the draw tube. Preferably, the bend is positioned closer to the distal end of the draw tube than to the dispensing tap. The bend of the draw tube divides the draw tube into generally straight elongate proximal and distal portions 26,27 each having a longitudinal axis. The proximal portion 26 of the draw tube is positioned adjacent the dispensing tube and the distal portion 27 of the draw tube is positioned adjacent the distal end of the draw tube. The longitudinal axes of the proximal and distal portions of the draw tube are extended at an acute angle to one another. Preferably, the acute angle between the longitudinal axes of the proximal and distal portions of the draw tube is between about 30 degrees and about 75 degrees. Ideally, the acute angle between the longitudinal axes of the proximal and distal portions of the draw tube is between about 60 degrees so that the distal end of the draw tube is positioned adjacent the lower corner of the beverage container to help ensure that the most amount of liquid in the beverage container may be drawn into the draw tube.

The proximal portion of the draw tube preferably has a region adjacent the dispensing tap forming a restriction coil 28. The restriction coil has a plurality of spirals coaxial with the longitudinal axis of the proximal portion of the draw tube. The spirals all have a diameter less than the diameter of the threaded opening of the beverage container to permit passage of the restriction coil into the beverage container.

A pressurized gas supply 29, such as a pressurized $CO_2$ cartridge, is provided for fluidly connecting with the interior of the beverage container so that pressurized gas from the pressurized gas supply is passed into the beverage container to increase the $CO_2$ pressure in the beverage container to force the pre-mixed carbonated beverage into the draw tube. Preferably, the pressurized gas supply is provided in the base housing. In this preferred embodiment, the base housing has an access opening 30 therein to permit removal of the pressurized gas supply from the base housing. The base housing has a threaded plug 31 threadably inserted into the access opening to close the access opening.

Preferably, an elongate flexible pressurizing tube 32 is provided for fluidly connecting the pressurized gas supply to the beverage container so that pressurized gas from the pressurized gas supply is passed through the pressuring tube into the beverage container. The pressurizing tube has a first end fluidly connected to the pressurized gas supply and a second end coupled to the dispensing tap. The second end of the pressurizing tube has an opening 33 adjacent the draw tube designed for positioning adjacent the threaded opening of the beverage container to fluidly connect the second end of the pressuring tube to the beverage container.

Preferably, the pressurizing tube has a pressure gauge 34 for visibly displaying to a user the amount of pressure of pressurized gas passing through the pressurizing tube to determine the amount of pressurized gas remaining in the pressurized gas supply. The pressure gauge is preferably mounted to the front of the base housing. The pressurizing tube also preferably has a regulator valve 35 for preventing passage of pressurized gas through the pressurizing tube above a predetermined amount of pressure. The regulator valve of the pressurizing tube is positioned between the pressure gauge and the second end of the pressurizing tube. Ideally, the predetermined amount of pressure of the regulator valve of the pressurizing tube is between about 18 psi and about 20 psi. The pressurizing tube also ideally has a pressure relief valve 36 for releasing pressurized gas from pressurizing tube when pressure in the pressurizing tube is greater than a predetermined amount of pressure. The pressure relief valve is positioned between the regulator valve and the second end of the pressurizing tube. Ideally, the pressure relief valve is incorporated into the dispensing tap.

A drip tray 37 is detachably attached to the front of the base container adjacent the bottom of the base container. The drip tray defines a reservoir 38 for holding a liquid therein. The reservoir of the drip tray is positioned beneath the dispensing spout for catching fluid dripping from the dispensing spout.

In use, the pressurized gas from the pressurized gas supply passes into the beverage container to increase the pressure in the beverage container to force the pre-mixed carbonated beverage into the draw tube and out the dispensing spout with the tap valve is opened.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dispenser for a pre-mixed carbonated beverage in a beverage container, said dispenser comprising:

a base housing having a top, a bottom, a front and a back;

said bottom of said base housing is adapted for resting on a resting surface;

said base housing having a cradle in said top of said base housing, said cradle of said base housing being adapted for receiving a beverage container therein;

a dispensing tap being adapted for attachment to a threaded opening of the beverage container to substantially cover the threaded opening of the beverage container;

said dispensing tap having a dispensing spout;

an elongate draw tube outwardly extending from said dispensing tap and being in fluid communication with said dispensing spout;

said draw tube being adapted for extending through the threaded opening of the beverage container into the beverage container;

said draw tube terminating at an open distal end; and a pressurized gas supply in fluid communication with said dispensing tap such that said gas supply is in fluid communication with the opening of the beverage container when said dispensing tap is attached to the beverage container.

2. The dispenser of claim 1, wherein said bottom of said base housing has a plurality of resting pads for resting on the resting surface.

3. The dispenser of claim 1, wherein said cradle of said base housing is adapted for holding the beverage container therein at an acute angle with respect to the resting surface.

4. The dispenser of claim 3, wherein said acute angle of said cradle is between about 30 degrees and about 75 degrees.

5. The dispenser of claim 3, wherein said acute angle of said cradle is about 60 degrees.

6. The dispenser of claim 1, wherein said cradle has a generally V-shaped upper saddle at said top of said base housing adjacent said front of said base housing, said upper saddle of said cradle being adapted for receiving a neck of the beverage container therein such that a threaded opening of the beverage container faces outwardly from said base housing in a upwards direction.

7. The dispenser of claim 1, wherein said draw tube has a bend located between said dispensing tap and said distal end of said draw tube, said bend of said draw tube dividing said draw tube into generally straight elongate proximal and distal portions each having a longitudinal axis, said proximal portion of said draw tube being positioned adjacent said dispensing tube, said distal portion of said draw tube being positioned adjacent said distal end of said draw tube, said longitudinal axes of said proximal and distal portions of said draw tube being extended at an acute angle to one another.

8. The dispenser of claim 7, wherein said acute angle between said longitudinal axes of said proximal and distal portions of said draw tube is between about 30 degrees and about 75 degrees.

9. The dispenser of claim 7, wherein said proximal portion of said draw tube has a region adjacent said dispensing tap forming a restriction coil, said restriction coil having a plurality of spirals coaxial with said longitudinal axis of said proximal portion of said draw tube.

10. The dispenser of claim 1, wherein an elongate flexible pressurizing tube is provided for fluidly connecting said pressurized gas supply to the beverage container, said pressurizing tube having a first end fluidly connected to said pressurized gas supply, said pressurizing tube having a second end coupled to said dispensing tap, said second end of said pressurizing tube having an opening adapted for positioning adjacent said threaded opening of the beverage container to fluidly connect said second end of said pressuring tube to the beverage container.

11. The dispenser of claim 10, wherein said pressurizing tube has a pressure gauge for visibly displaying the amount of pressure of pressurized gas passing through said pressurizing tube.

12. The dispenser of claim 11, wherein said pressurizing tube has a regulator valve for preventing passage of pressurized gas through said pressurizing tube above a predetermined amount of pressure.

13. The dispenser of claim 1, further comprising a drip tray being detachably attached to said front of said base container adjacent said bottom of said base container, said drip tray defining a reservoir for holding a liquid therein, said reservoir of said drip tray being positioned beneath said dispensing spout.

14. A dispenser for a pre-mixed carbonated beverage in a beverage container having a threaded opening therein, said dispenser comprising:

a base housing having a top, a bottom, a front and a back;

said bottom of said base housing being adapted for resting on a resting surface, said bottom of said base housing having a plurality of resting pads for resting on the resting surface, said resting pads comprising a resiliently deformable material for frictionally enhancing said resting pads to help prevent sliding of said resting pads on the resting surface;

said base housing having a cradle in said top of said base housing, said cradle of said base housing being adapted for receiving a beverage container therein;

said cradle of said base housing being adapted for holding the beverage container therein at an acute angle with respect to the resting surface, wherein said acute angle of said cradle is about 60 degrees;

said cradle having a generally V-shaped upper saddle at said top of said base housing adjacent said front of said base housing;

said upper saddle of said cradle being adapted for receiving a neck of the beverage container therein such that a threaded opening of the beverage container faces outwardly from said base housing in a upwards direction;

a dispensing tap being adapted for attachment to the threaded opening of the beverage container to substantially cover the threaded opening of the beverage container;

said dispensing tap having a dispensing spout and a tap valve for selectively opening and closing passage of fluid through said dispensing spout, said tap valve having a pivotally mounting lever actuator upwardly extending from said dispensing tap for permitting a user to selectively open and close said tap valve;

an elongate draw tube outwardly extending from said dispensing tap and being in fluid communication with said dispensing spout;

said draw tube being adapted for extending through the threaded opening of the beverage container into the beverage container;

said draw tube terminating at an open distal end, said distal end of said draw tube being adapted for positioning towards a bottom of the beverage container;

said draw tube having a bend located between said dispensing tap and said distal end of said draw tube, said bend being positioned closer to said distal end of said draw tube than to said dispensing tap;

said bend of said draw tube dividing said draw tube into generally straight elongate proximal and distal portions each having a longitudinal axis, said proximal portion of said draw tube being positioned adjacent said dispensing tube, said distal portion of said draw tube being positioned adjacent said distal end of said draw tube;

said longitudinal axes of said proximal and distal portions of said draw tube being extended at an acute angle to one another, wherein said acute angle between said longitudinal axes of said proximal and distal portions of said draw tube is between about 60 degrees;

said proximal portion of said draw tube having a region adjacent said dispensing tap forming a restriction coil, said restriction coil having a plurality of spirals coaxial with said longitudinal axis of said proximal portion of said draw tube;

a pressurized gas supply being adapted for fluid communication with the beverage container;

wherein said pressurized gas supply is provided in said base housing;

wherein an elongate flexible pressurizing tube is provided for fluidly connecting said pressurized gas supply to the beverage container;

said pressurizing tube having a first end fluidly connected to said pressurized gas supply;

said pressurizing tube having a second end coupled to said dispensing tap, said second end of said pressurizing tube having an opening adapted for positioning adjacent said threaded opening of the beverage container to fluidly connect said second end of said pressuring tube to the beverage container;

said pressurizing tube having a pressure gauge for visibly displaying the amount of pressure of pressurized gas passing through said pressurizing tube;

said pressure gauge being mounted to said front of said base housing;

said pressurizing tube having a regulator valve for preventing passage of pressurized gas through said pressurizing tube above a predetermined amount of pressure;

said regulator valve of said pressurizing tube is positioned between said pressure gauge and said second end of said pressurizing tube;

wherein said predetermined amount of pressure of said regulator valve of said pressurizing tube is between about 18 psi and about 20 psi;

said pressurizing tube having a pressure relief valve for releasing pressurized gas from pressurizing tube when pressure in said pressurizing tube is greater than a predetermined amount of pressure, said pressure relief valve being positioned between said regulator valve and said second end of said pressurizing tube;

a drip tray being detachably attached to said front of said base container adjacent said bottom of said base container; and said drip tray defining a reservoir for holding a liquid therein, said reservoir of said drip tray being positioned beneath said dispensing spout.

* * * * *